US006655549B2

(12) United States Patent
Duquet et al.

(10) Patent No.: US 6,655,549 B2
(45) Date of Patent: Dec. 2, 2003

(54) FLUID DISPENSER ASSEMBLY

(75) Inventors: Frédéric Duquet, Evreux (FR); Hervé Pennaneac'h, Verneuil sur Avre (FR)

(73) Assignee: Valois S.A., Le Neubourg (FR)

( * ) Notice: Subject to any disclaimer, the term of this patent is extended or adjusted under 35 U.S.C. 154(b) by 27 days.

(21) Appl. No.: 10/108,708

(22) Filed: Mar. 29, 2002

(65) Prior Publication Data

US 2002/0195469 A1 Dec. 26, 2002

Related U.S. Application Data

(60) Provisional application No. 60/291,327, filed on May 17, 2001.

(30) Foreign Application Priority Data

Mar. 30, 2001 (FR) ..... 01 04328

(51) Int. Cl.[7] ..... B65D 35/10

(52) U.S. Cl. ..... 222/103; 222/105; 206/484; 383/209

(58) Field of Search ..... 222/103, 105; 206/484; 383/209

(56) References Cited

U.S. PATENT DOCUMENTS 3,128,920 A * 4/1964 Volckening et al. ..... 206/484
3,301,395 A * 1/1967 Swezey ..... 206/484
3,469,743 A * 9/1969 Becker ..... 222/105
4,923,063 A * 5/1990 Tararuj ..... 206/484
4,998,621 A 3/1991 Meehan
5,368,199 A * 11/1994 Haas et al. ..... 222/146.5
5,937,617 A * 8/1999 Yeager ..... 383/209
6,264,065 B1 * 7/2001 Jouillat ..... 222/103
6,478,195 B2 * 11/2002 Duquet et al. ..... 222/183
6,540,079 B1 * 4/2003 Garcia et al. ..... 222/105
6,575,332 B2 * 6/2003 Abergel et al. ..... 222/105

FOREIGN PATENT DOCUMENTS

FR 2644141 A1 * 9/1990 ..... B65D/35/22
FR 2 796 368 1/2001

* cited by examiner

*Primary Examiner*—Kenneth Bomberg
(74) *Attorney, Agent, or Firm*—Sughrue Mion, PLLC

(57) ABSTRACT

A fluid dispenser assembly having, a fluid dispenser (1) defining a substantially flat body (10) provided with a dispensing orifice (12) and with a removable closure member (15) masking the dispensing orifice, packaging (2) encasing the body (10) of the dispenser while leaving the removable closure member (15) accessible so that it can be removed from the body. The dispenser assembly being characterized in that the packaging (2) comprises a casing portion (3) containing the body (10) of the dispenser; and a substantially plane portion (4) connected to the casing portion (3) by zones of least resistance (43), so that the casing portion (3) can be separated from the plane portion (4).

11 Claims, 1 Drawing Sheet

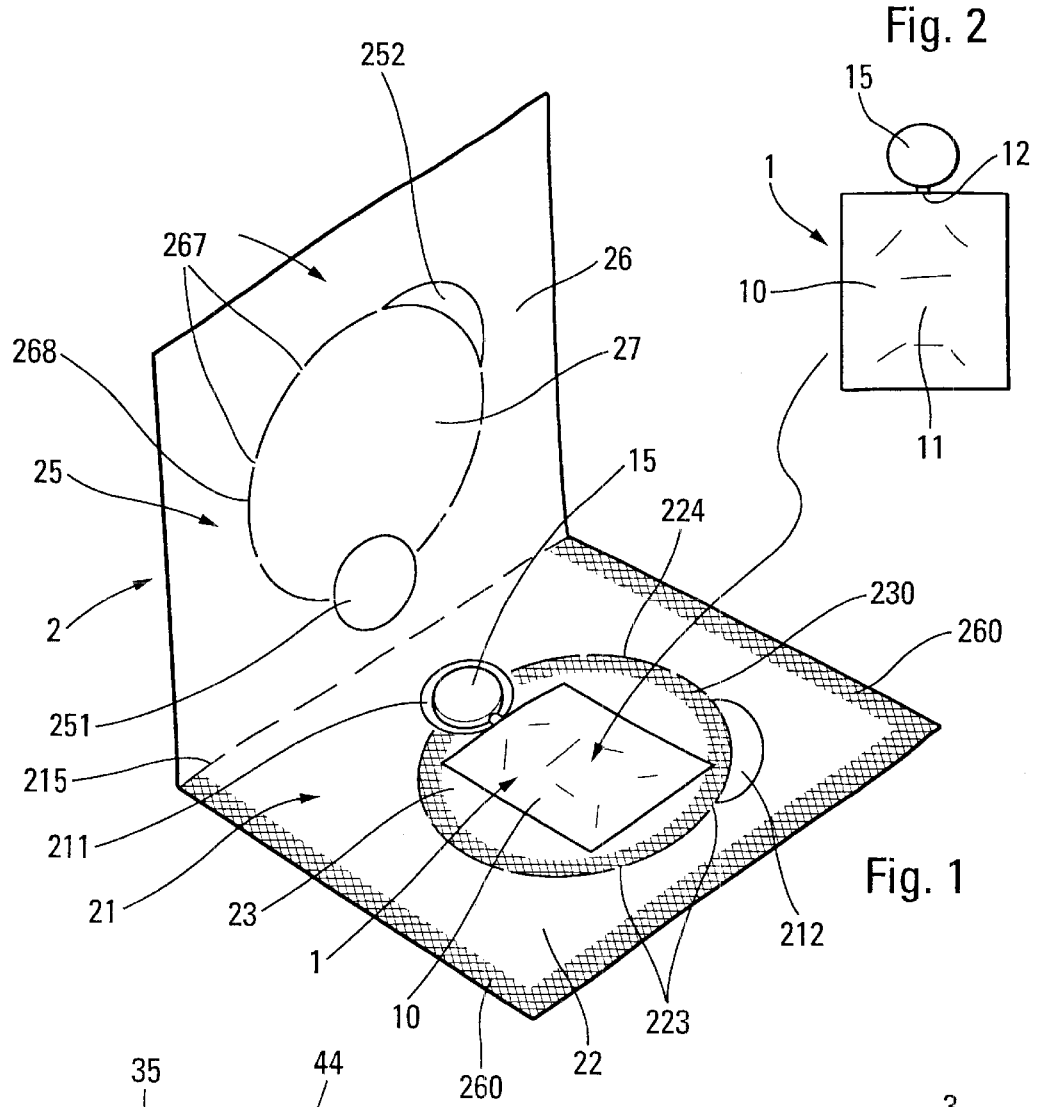
Fig. 2
Fig. 1
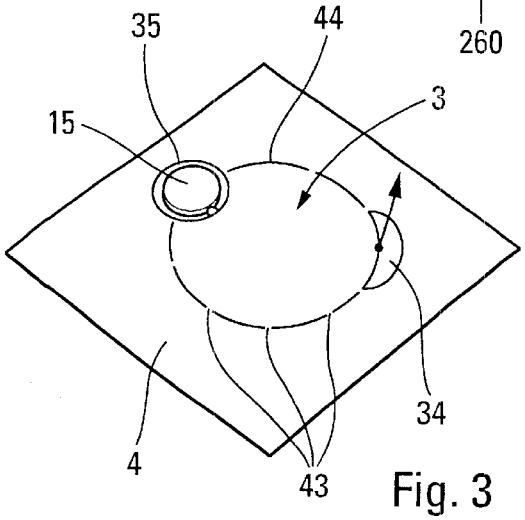
Fig. 3
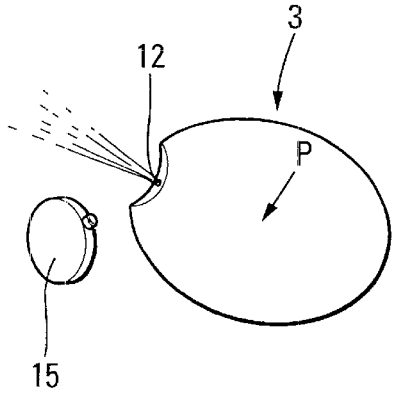
Fig. 4

FLUID DISPENSER ASSEMBLY

CROSS REFERENCE TO RELATED APPLICATION

This application claims the benefit under 35 U.S.C. §119 (e) of pending U.S. provisional patent application Serial No. 60/291,327, filed May 17, 2001, and priority under 35 U.S.C. §119(a)–(d) of French patent application No. FR-01.04328, filed Mar. 30, 2001.

TECHNICAL FIELD

The present invention relates to a fluid dispenser assembly comprising a fluid dispenser defining a substantially flat body provided with a dispensing orifice and with a removable closure member that masks the dispensing orifice prior to use. The dispenser assembly further comprises packaging encasing the dispenser while leaving the removable closure member accessible so that it can be removed from the body, thereby unmasking the dispensing orifice. Such dispenser assemblies can be used in the fields of perfumes, of cosmetics, or indeed of pharmaceuticals.

BACKGROUND OF THE INVENTION

Document FR 2 791 645 describes a fluid dispenser having a substantially flat body and a removable closure member which masks the dispensing orifice defined by the body. That fluid dispenser does not have any packaging encasing the body of the dispenser.

Document FR 2 784 361 describes a dispenser assembly comprising a fluid dispenser having a body and a removable closure member, and packaging encasing the body while leaving the removable closure member accessible so that it can be removed or folded back on the body. However, the dispenser assembly in that document is of significant thickness which prevents it from being included in a magazine by way of an advertising sample. In contrast, the dispenser described in FR-2 791 645, whose body is made up of two plane sheets that are bonded together over their peripheries so as to define a fluid reservoir between them, can be used for such a purpose. Prior to being used, the reservoir, which contains only a tiny quantity of substance, is constrained to remain at its minimum volume, and air is prevented from entering the reservoir by the presence of the removable closure member. Thus, the body of the dispenser is of small thickness, i.e. it is no thicker than 2 mm. It can therefore be included between the pages of a magazine.

Unfortunately, it is not easy to take hold of the dispenser in Document FR-2 791 645 because none of its faces are plane. In order to dispose such a dispenser in a magazine, machines are used that are equipped with suction-pad systems which take hold of the dispensers and remove them from a bin in which they are stacked vertically. It is essential for the dispenser to have at least one substantially plane face so that it can be taken hold of by the suction-pad system. In addition, it is necessary for the dispenser to be of standard dimensions and of simple geometrical shape, e.g. square or rectangular. That makes it easier to put it in place in the bin and to unload it from the bin by means of the suction-pad system.

BRIEF SUMMARY OF THE INVENTION

An object of the present invention is to remedy the above-mentioned drawbacks of the prior art by defining a dispenser assembly that has at least one substantially plane zone enabling it to be taken hold of by means of a suction-pad system. Another object of the invention is to provide a dispenser assembly in which the packaged dispenser has a shape that is independent of the shape of the packaging. Thus, the packaged dispenser can have a shape that is very pleasing in appearance, e.g. comparable to a stylized bottle, while the packaging as a whole has a simple geometric shape so that it is suitable for being easily manipulated, stored, or issued.

To achieve these objects, the invention makes provision for the packaging to comprise a casing portion containing the body of the dispenser, and a substantially plane portion connected to the casing portion by zones of least resistance, so that the casing portion can be separated from the plane portion by breaking the zones of least resistance. The casing portion is the portion that packages the body of the dispenser, and it can have a shape of very elaborate design, while outside of the plane portion connected to the casing portion can have a simple geometrical shape, e.g. square or rectangular.

Advantageously, the plane portion surrounds the casing portion at least in part. The casing portion may also lie entirely within the plane portion, so that the casing portion occupies a central portion of the packaging and the plane portion occupies a peripheral portion surrounding the casing portion. It is also possible for the casing portion to constitute a portion of an edge of the packaging.

According to a characteristic of the invention, the packaging is provided with a first cutout in which the removable closure member is received, said first cutout being situated between the casing portion and the plane portion. Thus, after removing the casing portion, the removable closure member is completely unobstructed so that it can be easily torn off or folded back so as to unmask the dispensing orifice.

According to another characteristic, the packaging is provided with an empty second cutout at which it is possible to take hold of the casing portion so as to detach it from the plane portion, said second cutout being situated between the casing portion and the plane portion. This empty second cutout is particularly useful when the casing portion lies entirely within the plane portion: it is then possible to take hold of the casing portion by inserting a finger through the empty cutout to take hold of the casing portion at a place on its periphery.

In another advantageous embodiment of the invention, the packaging comprises a backing first sheet and a cover second sheet, the casing portion and the plane portion being formed by the backing sheet and the cover sheet connected together.

Advantageously, the sheets in the casing portion are connected together over the periphery of the casing portion, except at the removable closure member, the body of the dispenser being fixed between the two sheets. In addition, the sheets in the plane portion are connected together over the periphery of the plane portion. Preferably, the backing sheet and the cover sheet form a single piece that is folded in half along one side. The packaging can thus be made of a single sheet of paper, of card, of plastic, of metal, or of a composite of these materials, which sheet is firstly cut out and then folded in half and fixed together, e.g. by adhesive or heat-sealing. Prior to that, the dispenser is naturally disposed between the two sheets, and preferably fixed, e.g. by adhesive, to the backing sheet where it defines the casing portion, before the two packaging sheets are finally sealed. In the casing portion, the two sheets are not touching outside their peripheries, since they receive the fluid dispenser between them. However, the backing sheet and the cover sheet may be touching in the plane portion, so as to define a substantially plane surface zone suitable for being taken hold of by the suction-cup system.

BRIEF DESCRIPTION OF THE DRAWINGS

The invention is described more fully below with reference to the accompanying drawings which show an embodiment of the invention by way of non-limiting example.

In the: figures:

FIG. 1 is a perspective view of a dispenser assembly of the invention with its packaging open so as to leave the fluid dispenser visible;

FIG. 2 is a plan view of the fluid dispenser used in the dispenser assembly of FIG. 1;

FIG. 3 is a perspective view on a smaller scale of the dispenser assembly of FIG. 1 in the finished state; and FIG. 4 is a diagrammatic perspective view of the casing portion with its dispenser and the removable closure member removed.

DETAILED DESCRIPTION

The fluid dispenser assembly of the invention comprises a fluid dispenser 1 and packaging 2 in which the dispenser 1 is received.

The dispenser 1 may be of the type described in Application FR 2 791 645 which is incorporated herein by way of reference. The dispenser 1 includes a body 10 that is substantially flat and that is made up of one or two flexible sheets bonded together over their peripheries. The two sheets of the body 10 thus together define an internal volume which serves as a fluid reservoir. Advantageously, the body is also provided with a support and dispensing part which defines a dispensing orifice and which communicates with the reservoir. In a practical embodiment, the support and dispensing part may be constituted by a piece of plastic fixed between the two sheets, e.g. by heat-sealing. This support and dispensing part may also serve to support a piece of porous material capable of becoming soaked with fluid. The piece of porous material extends inside the reservoir and it communicates directly with the outlet orifice. In addition, the reservoir may contain a spring element such as a resilient blade against which it is possible to press through the sheets. As a result, one of the sheets constitutes an actuating wall 11 or both of the sheets constitute actuating walls, against which the user presses to expel the fluid from the reservoir through the piece of porous material and through the dispensing orifice. In addition to the body 10, the dispenser 1 further includes a removable closure member 15 which masks the dispensing orifice 12 prior to use. The removable closure member 15 may be made integrally with the support and dispensing part, or else it may be made integrally with the sheets of the body 10. Before the removable closure member 15 is removed, the reservoir 10 is constrained to remain at its minimum volume, so that it contains almost nothing but the fluid. As soon as the removable closure member is removed, air can penetrate into the reservoir through the dispensing orifice 12 so that the spring member that is situated inside the reservoir can relax towards its rest position, thereby increasing the volume of the reservoir. By pressing on the actuating wall(s) 11, the fluid is dispensed in two-phase manner via the dispensing orifice 12.

A dispenser identical to the dispenser in Document FR 2 791 645 is used in the dispenser assembly of the invention, and it is shown diagrammatically in FIGS. 1 and 2. Naturally, it is possible to use other types of fluid dispenser in which the fluid is dispensed by pushing in an actuating wall. The only requirement is that the body of the dispenser must be relatively flat. In this example, the body 10 of the dispenser 1 is no thicker than in the range 2 mm to 3 mm. Naturally, the dispenser 1 is put in place in the packaging 2 with the removable closure member 15 connected to the body, so that the body 10 of the dispenser is still substantially flat and thin.

The packaging 2 is made up of two sheets of paper, of card, of plastic, of metal, or of a composite thereof. For example, it is possible to use a composite film of paper and of plastic. The two sheets referenced 21 and 25 may be exactly identical. They may also be connected together along a line 215 which serves as a hinge line and which subsequently defines an external side of the packaging. Thus, the two sheets may be made up of the same sheet folded in half along the line 215. Naturally, it is also possible for the packaging 2 to be made up of two totally separate sheets 21 and 25.

Each sheet 21 and 25 is precut symmetrically about the line 215 so that the precuts are superposed on one other once the sheet 25 is folded over on the sheet 21. More particularly, the precuts essentially define two types of portion, namely a respective casing portion 23 or 27 of each of the sheets 21 and 25, and a respective peripheral portion 22 or 26 of each of the sheets 21 and 25. Once folded in half as shown in FIG. 3, the casing sheet portions 23 and 27 define a casing portion 3 and the peripheral sheet portions 22 and 26 define the peripheral portion 4. The precuts on the sheets 21 and 25 may be constituted by slots 224 and 268 interrupted by bridges of material 223, 267. Once folded in half, the slots and the bridges of material are mutually superposed so as to form the slots 44 and the bridges of material 43 as shown in FIG. 3. Thus, the casing portion 3 is connected to the peripheral portion 4 by the bridges of material 43, and it is separated therefrom by the slots 44.

Each of the sheets 21 and 25 is also provided with respective empty cutouts 211 & 212 or 251 & 252. The empty cutouts 211 and 251 form the cutout 35 and the cutouts 212 and 252 form the cutout 34, once the two sheets are folded over on each other as shown in FIG. 3. The empty cutout 35 serves to receive the removable closure member 15 of the dispenser 1, while the cutout 34 remains empty and serves as a handle recess for facilitating taking hold of the casing portion 3 for the purpose of separating it from the peripheral portion 4 along the slots 44 by breaking the bridges of material 43.

The sheets 21 and 25 may be exactly symmetrical, but one of the sheets (sheet 21 in this example) may serve as a backing sheet for the fluid dispenser 1, as can be seen in FIG. 1. In other words, the dispenser 1 may be disposed on and advantageously fixed to the backing sheet 21 at its casing portion 23. It is possible to stick one of the sheets of the body 10 to the casing sheet portion 23 by means of a suitable adhesive. The dispenser 1 is positioned on the sheet portion 23 so that its removable closure member 15 is received in the cutout 211 which, together with the symmetrical cutout 251, forms the cutout 35 in the FIG. 3. Thus, the dispensing orifice 12 is accurately disposed on the periphery of the cutout 35. The periphery 230 of the casing sheet portion 23 may advantageously be coated with a suitable adhesive that extends around the dispenser 1, as shown in FIG. 1. Once the cover sheet 25 has been folded over onto the backing sheet 21, the casing sheet portion 27 sticks to the casing sheet portion 23 at their corresponding peripheries. Thus, the two casing sheet portions 23 and 27 are secured to each other over their peripheries, with the dispenser 1 disposed between them. This is shown in FIG. 4, in which only the casing portion 3 is shown, with the removable closure member 15 removed so as to unmask the dispensing orifice 12 formed by the body 10 of the dispenser 1. As its name would suggest, the casing portion 3 literally encases the body 10 of the dispenser 1 while leaving its removable closure member accessible so that it can be removed easily, thereby unmasking the dispensing orifice 12. It is thus possible to remove the casing portion 3 from the peripheral portion 4 by breaking the bridges of material 43 along the slots 44. The two casing sheet portions 23 and 27 are secured together while holding the dispenser 1 captive between them.

Advantageously, it is also possible to fix the peripheral sheet portions 22 and 26 together along their peripheries 260. It is thus possible to apply a suitable adhesive along the periphery 260 of the backing sheet 21; it is unnecessary to apply the adhesive along the line 215 along which the sheets 21 and 25 are connected together. Once folded over and applied against each other, the outer peripheries of the peripheral sheet portions 22 and 26 are fixed together. Thus, once the casing portion 3 has been removed from the peripheral portion 4, the peripheral sheet portions 22 and 26 remain connected together. It is possible to omit sticking the sheet portions 22 and 26 together, since the sheets 21 and 25 are already fixed to each other at the casing portion 3.

Although it contains the body 10 of the dispenser 1, the casing portion 3 is substantially flat and plane. Actually, the casing sheet portions 23 and 27 are slightly curved or convex. The peripheral portion 4 is substantially plane and its sheet portions 22 and 26 are touching even outside the zone where they are stuck together. The dispenser assembly can thus be taken hold of by a suction-pad system at the casing portion 3, and even more easily at the plane peripheral portion 4. In addition, it is very easy to apply indications such as the trademark, the ingredients, and the instructions for use of the fluid on the casing portion 3 and on the peripheral portion 4.

It should also be noted that the shape of the casing portion 3 is totally independent of the outside shape of the peripheral portion 4: the casing portion 3 can be very stylized, while the portion 4 can be geometrically very simple, e.g. square or rectangular. The shape of the casing portion 3 is very simple to modify or to stylize by acting on the configuration of the cutouts 44.

In the embodiment shown in the figures, the casing portion 3 occupies a central position, while the portion 4 extends all the way around the casing portion 3. However, it is possible to consider other forms of embodiment in which the casing portion 3 opens out on an external side of the packaging 2 so that the portion 4 surrounds the casing portion 3 in part only. It is even possible to consider a dispenser assembly in which the slots 44 and the bridges of material 43 extend rectilinearly along a single line. But preferably, for reasons of appearance, the envelope portion 3 occupies a central position, with the portion 4 extending all the way around it. In addition, the casing portion 3 is thus exactly protected by the peripheral portion 4.

With such packaging, it is easy to store it and to take hold of it, since the packaging is relatively flat, and even exactly flat at its peripheral portion 4, and since it has an external shape that is geometrically simple.

What is claimed is:

1. A fluid dispenser assembly comprising:

a fluid dispenser (1) defining a substantially flat body (10) provided with a dispensing orifice (12) and with a removable closure member (15) masking the dispensing orifice; and packaging (2) encasing the body (10) of the dispenser while leaving the removable closure member (15) accessible so that it can be removed from the body;

said dispenser assembly being characterized in that said packaging (2) comprises:

a casing portion (3) containing the body (10) of the dispenser; and a substantially plane portion (4) connected to the casing portion (3) by zones of least resistance (43), so that the casing portion (3) can be separated from the plane portion (4).

2. A dispenser assembly according to claim 1, in which the plane portion (4) surrounds the casing portion (3) at least in part.

3. A dispenser assembly according to claim 1, in which the casing portion (3) lies entirely within the plane portion (4).

4. A dispenser assembly according to claim 1, in which the packaging (2) is provided with a first cutout (35) in which the removable closure member (15) is received, said first cutout (35) being situated between the casing portion (3) and the plane portion (4).

5. A dispenser assembly according to claim 1, in which the packaging (2) is provided with an empty second cutout (34) at which it is possible to take hold of the casing portion (3) so as to detach it from the plane portion (4), said second cutout (34) being situated between the casing portion (3) and the plane portion (4).

6. A dispenser assembly according to claim 1, in which the packaging (2) comprises a backing first sheet (21) and a cover second sheet (25), the casing portion (3) and the plane portion (4) being formed by the backing sheet (21) and the cover sheet (25) connected together.

7. A dispenser assembly according to claim 6, in which the sheets (23, 27) in the casing portion (3) are connected together over the periphery (230) of the casing portion, except at the removable closure member (15), the body (10) of the dispenser being fixed between the two sheets.

8. A dispenser assembly according to claim 6, in which the sheets (21, 25) in the plane portion (4) are connected together over the periphery (260) of the plane portion (4).

9. A dispenser assembly according to claim 6, in which the backing sheet (21) and the cover sheet (25) forms a single piece that is folded in half along one side (215).

10. A dispenser assembly according to claim 6, in which the backing sheet (21) and the cover sheet (25) are touching in the plane portion (4).

11. A dispenser assembly according to claim 1, in which the zones of least resistance comprise slots (44) and breakable bridges of material (43) interconnecting the two portions (3, 4).

* * * * *